US005933065A

United States Patent [19]

Duchemin

[11] Patent Number: 5,933,065

[45] Date of Patent: Aug. 3, 1999

[54] CONTROL AND SIGNALLING DEVICE FOR PROTECTIVE SWITCHING APPARATUS

[75] Inventor: Pierre Duchemin, Fourqueux, France

[73] Assignee: Schneider Electric SA, Boulogne Billancourt, France

[21] Appl. No.: 08/722,552

[22] Filed: Sep. 27, 1996

[30] Foreign Application Priority Data

Sep. 28, 1995 [FR] France ..... 95 11545

[51] Int. Cl.[6] ..... H01H 67/02

[52] U.S. Cl. ..... 335/190; 335/6; 335/13; 335/132; 335/171; 335/189; 200/574

[58] Field of Search ..... 335/132, 190, 335/192, 202, 6, 11, 13, 17, 21, 22, 26, 27, 167, 171, 172, 189, 191; 200/336, 368, 569, 574

[56] References Cited

U.S. PATENT DOCUMENTS

| | | | |
|---|---|---|---|
| 3,651,436 | 3/1972 | Cooper et al. | 335/13 |
| 5,166,653 | 11/1992 | Bosch et al. | 335/236 |
| 5,546,062 | 8/1996 | Duchemin | 335/132 |

FOREIGN PATENT DOCUMENTS

| | | |
|---|---|---|
| 0 628 981 A1 | 12/1994 | European Pat. Off. . |
| 2 538 160 | 6/1984 | France . |

*Primary Examiner*—Michael L. Gellner
*Assistant Examiner*—Raymond Barrera
*Attorney, Agent, or Firm*—Oblon, Spivak, McClelland, Maier & Neustadt, P.C.

[57] ABSTRACT

The present invention relates to a control and signalling device for a protective switching apparatus of the relay switch type which is provided with power switches (1) and a protection assembly (4) and is capable of detecting faults (overloads or overcurrents) on each current path associated with a switch (1), this device being actuated by a manual control member (51) which can take an operating "run" position corresponding to closed contacts, a "stop" position corresponding to open contacts and a "trip" position corresponding to the position after detection of a fault, characterised by the fact that it comprises a mobile spring loaded cam (52) actuated by a triggering spring (54) and capable of—from the "run" position in which it is locked by an automatic interlock (55) and after the triggering and release of the interlock (55)—of turning the manual control member (51) which then actuates the coil switch (81).

20 Claims, 3 Drawing Sheets

SECTION II-II

SECTION III-III

FIG. 4
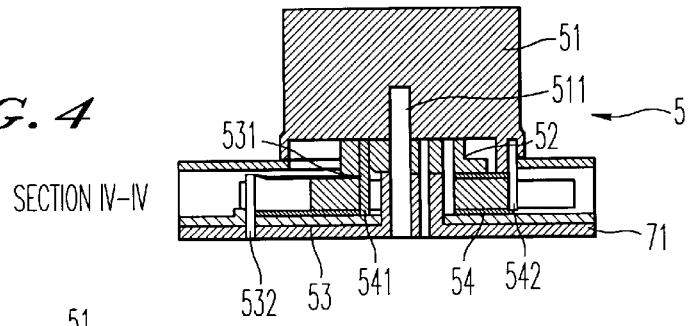
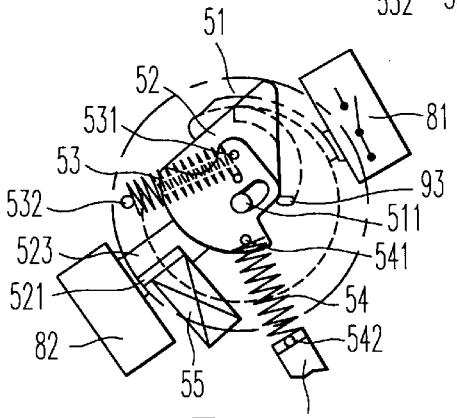
FIG. 5
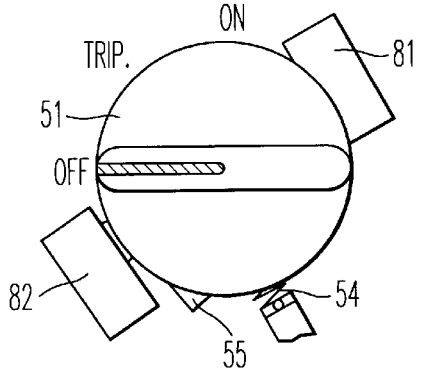
FIG. 6
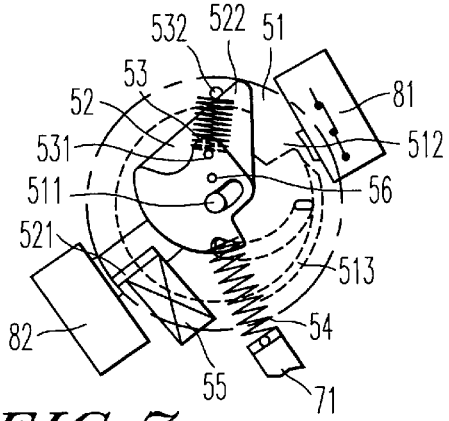
FIG. 7
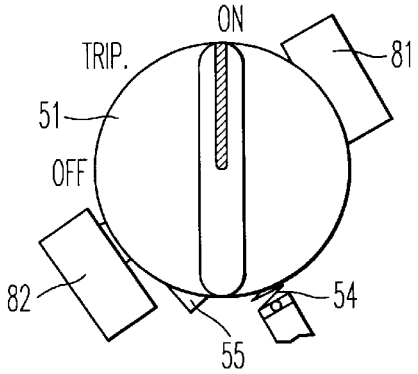
FIG. 8
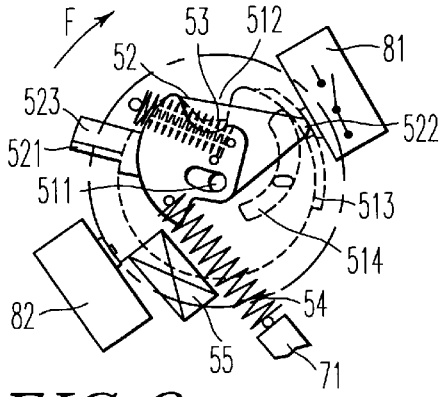
FIG. 9
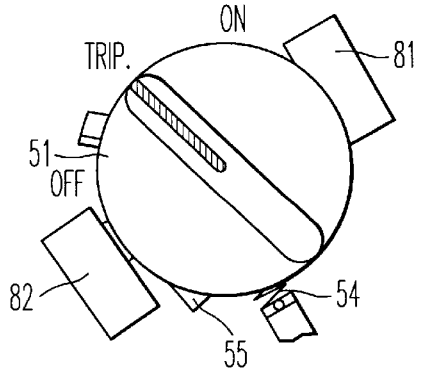
FIG. 10

CONTROL AND SIGNALLING DEVICE FOR PROTECTIVE SWITCHING APPARATUS

BACKGROUND OF THE INVENTION

1. Field of the Invention

The present invention relates to a control and signalling device intended for protective switching applications, particularly relay-switches provided with a protective assembly capable of detecting faults (overloads or overcurrents) on each current path associated with a power pole, such device being actuated by a manual control member which may be in a 'ON' position corresponding to closed contacts, a 'OFF' position corresponding to open contacts and a 'TRIP' position corresponding to the position after detection of a fault.

2. Description of the Related Art

On motor cut-out switches or relay switches the control and signalling elements are described as interlocks.

A motor cut-out switch or manual starter permits control of the poles either manually, or via a thermal and magnetic triggering assembly which provides a protective function. When an electrical fault is detected on one of the line phases, the thermal or magnetic device of the corresponding phase triggers the opening of contacts by means of a shared interlock. The latter may further be manually actuated by a manual control.

A relay switch combines both a contactor and a circuit breaker. It comprises a magnetic and/or thermal trigger unit and an electromagnet which controls the poles to ensure the contactor function. The motor cut-out switch or manual starter mentioned earlier includes similar means to activate its contacts but lacks an electromagnet.

An interlock relay switch permits control of the 'ON', 'OFF', 'TRIP' and reset functions and it also make the position of the contacts visible through the manual position of the control button of this interlock.

Numerous interlock devices exist but they are often complicated, costly, bulky, and of complex and delicate operation.

SUMMARY OF THE INVENTION

The aim of the present invention is to provide a control and signalling device that is simple, reliable, quiet and inexpensive. It generates little friction and does not require large physical effort to be operated by the operator. It provides smooth operation whatever the size or power of the equipment. It may be mounted directly on the equipment itself or be distant from it. Moreover, it can be used on equipment of different sizes.

The device according to this invention is characterised in that it comprises a moveable control knob which can be tripped by the action of a triggering spring loaded cam and which can, from the 'run' position in which it is held by an automatic interlock, after triggering and freeing by the interlock, activate the manual control knob which in turn activates the coil switch.

One particular feature is that the spring loaded cam and the manual control knob are both operated by a tilting spring.

DESCRIPTION OF THE PREFERRED EMBODIMENTS

The invention will now be described in more detail, referring to embodiments given by way of example and illustrated by the appended drawings in which:

FIG. 4 is an axial section along line IV—IV on FIG. 2;

FIGS. 5 and 6 show the device according to the invention in the "OFF" position (with the control knob removed and the control knob in place, respectively);

FIGS. 7 and 8 show the device in the "ON" position;

FIGS. 9 and 10 show the device in the "TRIP" position;

Figure 1:
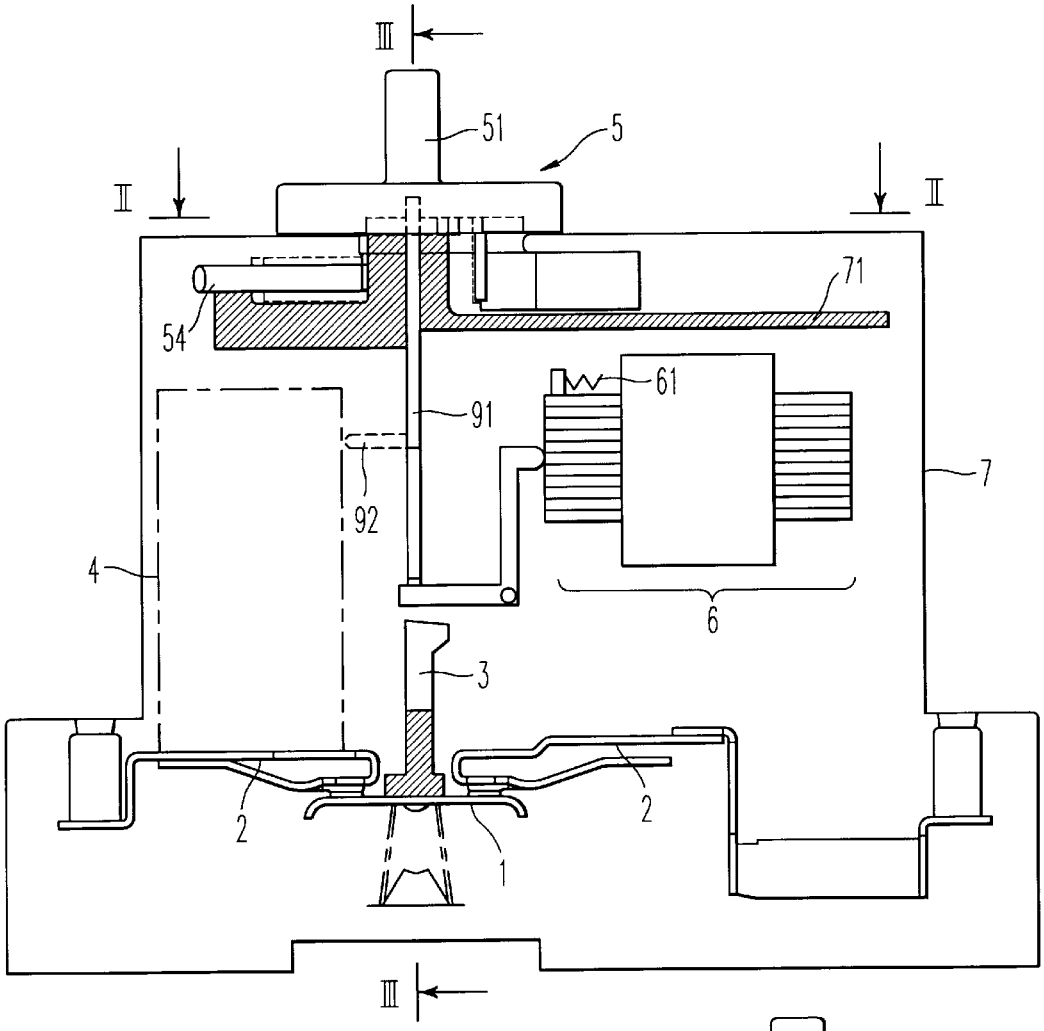
FIG. 1 is a diagram of the relay switch fitted with the control and signalling device according to the invention.
Figure 2:
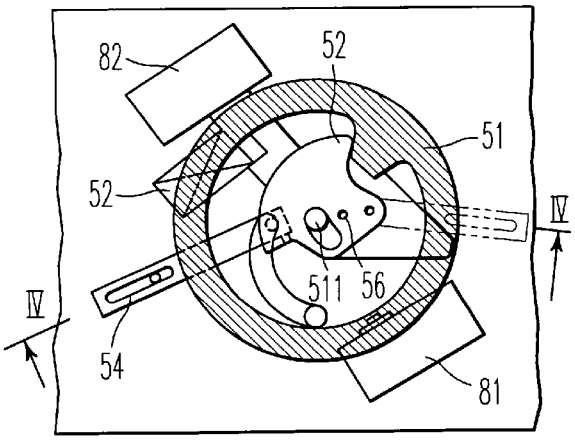
FIG. 2 is a section along line II—II on FIG. 1.
Figure 3:
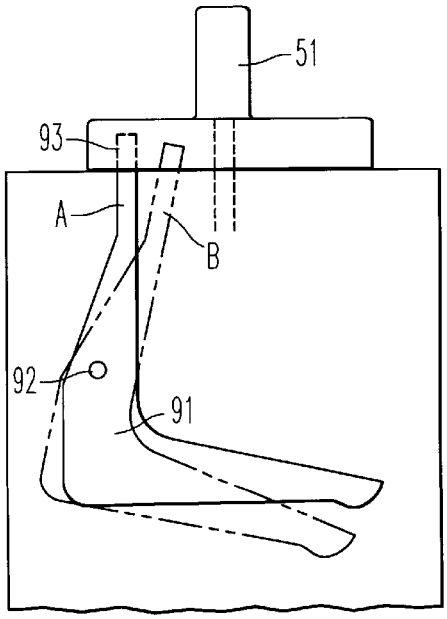
FIG. 3 is a sectional view along line III—III of the device.
Figure 11:
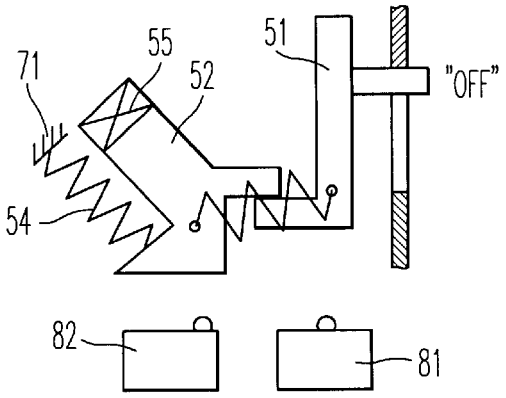
FIGS. 11, 12 and 13 show a variant of the device in the position of "OFF", "ON" and "TRIP" respectively.
Figure 12:
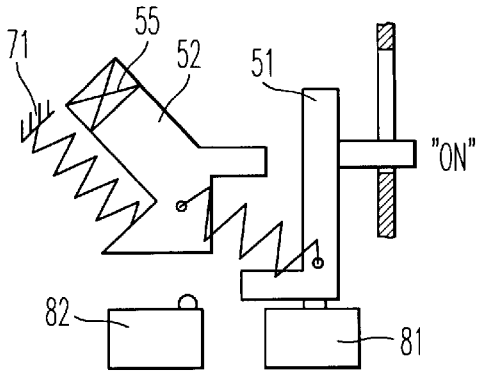
Figure 13:
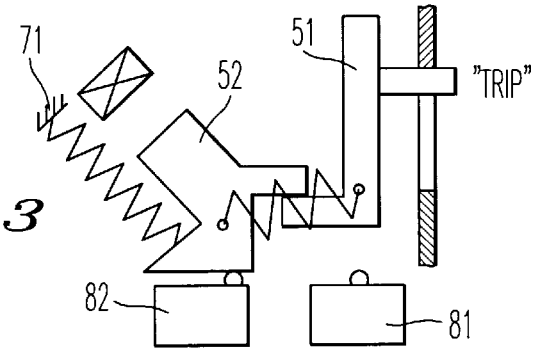

The control and signalling device according to the invention, indicated 5, is intended to be fitted to protection apparatus such as that shown in FIG. 1. This apparatus is of a relay switch type and comprises several pole contacts capable of cutting the current on current paths which terminate in connection terminals for connection of electrical wires. Only a single pole of the double break type is shown in FIG. 1 in order to simplify the drawing.

Each pole comprises a bridge of mobile contacts 1 which co-operate with fixed contacts to establish or interrupt the passage of current between the connection terminals. The fixed contacts are connected to the connection terminals to which the external wires are jointed by means of wires 2.

A contact-bearer assembly 3 which carries the contact bridges 1 slides in the housing 7, perpendicular to the plane of the fixed contacts.

An electromagnet 6 lodged in the housing comprises a fixed magnetic circuit, a mobile magnetic circuit linked mechanically to the contact-bearer assembly 3 and a coil whose terminals are linked to a power supply source, the power supply of the coil being controlled by a coil switch 81. The mobile circuit of the electromagnet is biased by a return spring 61 which, when the coil is no longer excited, moves it as well as the contact-bearer 3 to the open position (contacts open).

A protection assembly 4 is incorporated in the apparatus in such a way as to detect any overload or overcurrents in each current path associated with a pole. When this electrical protection assembly 4 detects an overcurrent or an overload on a current path, it controls the opening of the poles via the device 5. This protection assembly 4 is of the magnetic and/or thermal type, or of the electronic type.

The device 5 which is shown in detail in FIGS. 2 to 10, comprises, apart from the manual selector member 51, a mobile spring loaded cam 52.

The manual selector member 51 moves between three main positions: "run" or "ON" (contacts closed), "stop" or "OFF" (contacts open), "tripped" or "TRIP" (contacts open upon default).

The device comprises switches (or contacts) 81 and 82. Switch 81 is the contact coil. In the embodiment shown in FIGS. 2 to 10, switch 82 is a signalling contact. As an indication, micro-switches may be employed for switches 81 and 82.

The cam 52 is spring loaded, on one hand from the tilting spring 53 pivoting on the manual selector member 51, and on the other hand, from the trigger spring 54 which presses against the keeper plate 71.

One end of the tilting spring 53 is coupled at a tilting spring lobe 531 to the spring loaded cam 52, while the other end is coupled at 532 to the manual selector member 51.

One end of the trigger spring 54 is coupled at a trigger spring lobe 541 on the spring loaded cam 52, while the other extremity is coupled at 542 on keeper plate 71.

The spring loaded cam 52 acts in co-operation with an automatic interlock 55 which can hold it in a locked position ("ON" position in FIGS. 7 and 8 or "OFF" position in FIGS. 5 and 6) or free it (when the interlock is activated by the protection assembly 4) in such a way that it then assumes the "TRIP" position shown in FIGS. 9 and 10. This interlock 55 is therefore capable of immobilising the spring loaded cam 52, by its lever or interlock lobe 523, in the locked position (FIGS. 5 to 8) which corresponds to either the "ON" position or the "OFF" position, these positions "ON" or "OFF" being indicated by the control member 51.

By way of example, the automatic interlock 55 can be of an electromagnetic type and it is then made up of a permanent magnet associated to an unlocking coil. The spring loaded cam 52 is provided with a magnetic material section 521 (adjacent to 523) and which is able to be attracted by the permanent magnet of the interlock 55. During unlocking, the magnetic field of the permanent magnet is cancelled out by the electromagnetic field produced by the unlocking coil.

Alternatively, the automatic interlock 55 could be composed of a latch that is unlocked electrically.

In the embodiment shown in FIGS. 2 to 10, the control member 51 is a knob rotatably mounted about an axis 511, on plate 71, so as to pivot between the three main positions: "run" or "ON" (contacts closed), "stop" or "OFF" (contacts open), "tripped" or "TRIP" (contacts open upon default).

The spring loaded cam 52 is pivotally mounted about an axis 56 on plate 71. The pivot axis 56 of the cam 52 is parallel to the axis of 511 and in proximity to it. Alternatively, the pivot axis 56 of the cam may coincide with pivot axis 511 of knob 51.

The spring loaded cam 52 actuates switch 82 by means of finger or cut off lobe 522.

In the "OFF" position (FIG. 5), the knob 51, by means of its cam lobe 513, acts upon the coil switch 81 and opens it. In the "ON" position, the knob and its cam lobe 513 no longer actuate switch 81 which is thus in a closed position (FIG. 7).

When cam 52 is in its locked position ("ON" or "OFF" position) (FIGS. 5 and 7), it acts upon the signalling switch 82. As soon as the spring loaded cam 52 moves towards the "tripped" position, i.e. in case of a fault being detected by the protection assembly 4, it no longer acts upon signalling switch 82.

The control member 51 incorporates a stop 512 which can abut with cam 52 in such a way so as to cause it to rotate as soon as an operator turns the control member 51.

It is possible forcibly actuate upon the power contacts by means of an additional mechanism. This mechanism comprises a pivoting lever 91 which is actuated by the knob 51 and which acts upon the contact bridge 3. Lever 91 can pivot about an axis 92. The end 93 of the lever is guided in a slot 514 of the knob 51, whereby, depending upon the position of the knob, the lever moves or not the contact bridge 3 (position A or B).

The operation of the device shown in FIGS. 2 to 10 will now be explained by referring to the drawings.

In the "OFF" position shown in FIGS. 5 and 6, the spring loaded cam 52 is locked in the locked position by the automatic interlock 55. The triggering spring 54 is compressed. The coil switch 81 is open.

In order to proceed from "OFF" (FIGS. 5 and 6) to "ON" (FIGS. 7 and 8), the operator turns the selector knob 51 from "Stop" (or "OFF") to "Run" (or "ON"). The spring loaded cam 52 is held from rotation by interlock 55. During the turning of the selector knob 51, the axis of spring 53 tilts from one side to the other of the line of thrust 532-56. At the end of its travel, the knob 51 triggers the closing of coil switch 81 (cam lobe 513 clears from the switch pusher). Electromagnet 6 is then supplied with current and the contact-bearer 3 moves so as to close the poles.

In order to proceed from "run" to "stop", the above operations are reversed.

In the case of a fault (overload or short circuit), a triggering instruction is provided by the protection assembly 4 and sent, via an electrical link, to the electromagnetic interlock 55. This frees the spring loaded cam 52 which, by means of the thrust of spring 54, begins to turn (direction f) towards the "tripped" position illustrated in FIGS. 9 and 10. The tilting spring 53 is compressed in this initial phase. At a certain moment, the axis of spring 53 crosses the line of thrust 532-56. Spring 53 through its tilting action pivots the knob 51 in relation to the spring loaded cam 52 and in the opposite direction of the rotation direction f of this cam 52. The knob 51 moves from the "Run" position to the "Trip" position as shown in FIGS. 9 and 10. During its rotation, the knob 51 opens switch 81 (via cam lobe 513) which cuts the current to the coil. Simultaneously, finger 522 of cam 52 opens switch 81. Because of this, the electromagnet 6 opens and the poles open.

It should be noted that rotation of cam 52 actuates the signalling switch 82.

The turning of the knob 51 relative to the spring loaded cam 52 is finally halted by stop 512. Spring 53 finally actuates on cam 52 in the same direction as spring 54.

To move from the "Trip" position (FIGS. 9 and 10) to the "Stop" position (FIGS. 5 and 6), the operator turns the knob 51 in the opposite direction of f. This, by means of stop 512, moves cam 52 which then returns to its locked position as shown in FIGS. 5 and 6. At the end of its travel, the automatic interlock 55 locks the spring loaded cam 52 in its locked position, the knob 51 being on the "Stop" position.

To move from the "Trip" position to the "Run" position, the operator carries out the previously described operation and further turns the knob 51 to the "Run" position.

If the operator holds the knob 51 on the "Run" position during a short-circuit, the cam 52 via its lobe 522 will trigger and open switch 81 (see FIG. 9).

The device shown in FIGS. 11 to 14 differ from the one FIGS. 2 to 10 in that the movements of cam 52 and the control member 51 are linear whereas the movements of those same components in the device in FIGS. 2 to 10 are rotative. Operation is nevertheless similar to the operation of the rotative device.

Figure 14:
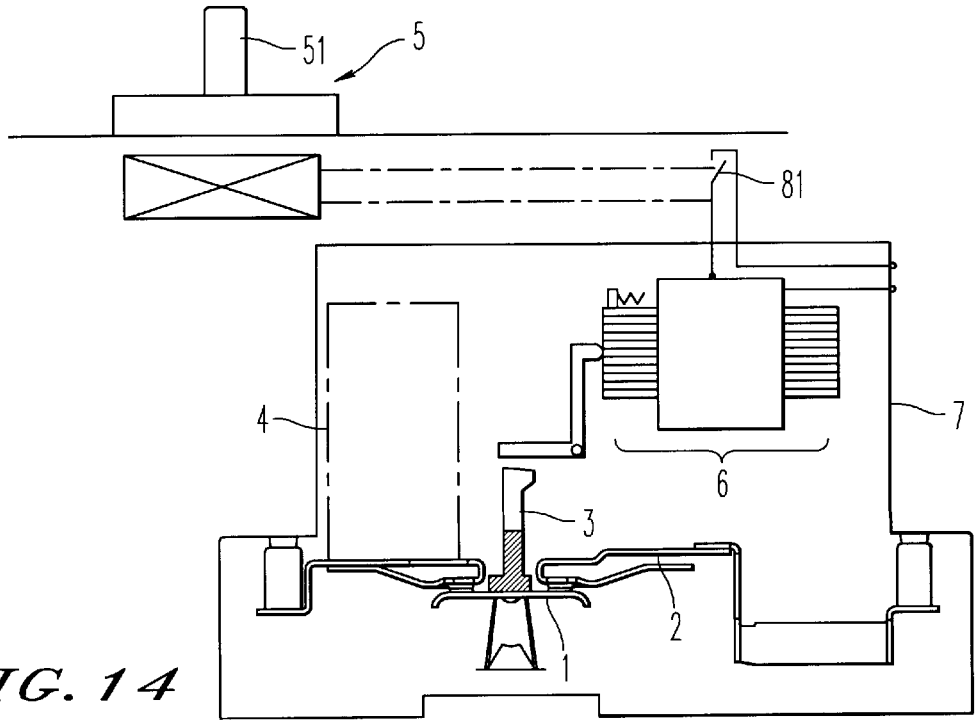
FIG. 14 shows a device mounted distant from the equipment it controls.

In FIG. 14, an assembly in which device 5 is away from the apparatus 7 housing the electromagnet, the switches and the protection assembly. The device could, for example, be mounted on the door of an electrical cabinet with the apparatus itself being mounted at the back of the cabinet.

Obviously, without departing from the scope of the invention, variants and improvements to details can be made as well as providing the use of equivalent means.

As a variant, a second switch can be associated with the first coil switch, both switches being connected in series on the coil supply. This second switch is actuated after triggering by finger 522 of cam 52.

As a variant, the device can be provided with an extension spring instead of a compression spring 53.

I claim:

1. A protective switching apparatus for a control and signaling device comprising:

a coil switch;

a manual control member moveable between a run position corresponding to closed contacts in said coil switch, a stop position corresponding to open contacts in the coil switch, and a trip position corresponding to the position after detection of a fault;

a mobile spring loaded cam moveable between a locked position and a tripped position, said mobile spring loaded cam including a triggering spring lobe, an interlock lobe, and a cut off lobe configured to communicate with the coil switch when said cam is in the tripped position;

a triggering spring with a first end connected to said triggering spring lobe, said triggering spring biases said mobile spring loaded cam to open said coil switch; and an automatic interlock which releasably locks said interlock lobe and thereby locks said mobile spring loaded cam in the locked position against the bias provided by said triggering spring;

wherein said interlock is configured to release said interlock lobe after said interlock is triggered thereby allowing said cam to open said coil switch.

2. A device according to claim 1, further comprising a second switch in communication with said mobile spring loaded cam, said second switch serving either for signaling or as coil contacts.

3. A device according to claim 1, wherein said automatic interlock is of the electromagnetic type and made up of a permanent magnet in association with an unlocking coil.

4. A device according to claim 1, wherein the control member comprises a knob rotatably mounted about an axis on a mounting plate, so that it pivots between the run, stop and trip positions.

5. A device according to claim 1, wherein the spring loaded cam pivots about an axis on a mounting plate.

6. A device according to claim 1, wherein said manual control member comprises a knob and is provided with a cam lobe capable of actuating the coil switch.

7. A device according to claim 1, wherein said spring loaded cam further comprises a second finger serving to actuate signaling switch.

8. A device according to claim 1, wherein said manual control member comprises a knob fitted with a stop capable of turning the spring loaded cam.

9. A device according to claim 1, wherein the device can be distant from an apparatus housing an electromagnet, said coil switch and a protection assembly for detecting an electrical fault and signaling said automatic interlock upon detection of an electrical fault.

10. A device according to claim 1, wherein said cam and said manual control member are biased by a tilting spring.

11. A device according to claim 10, further comprising a tilting spring, wherein a first end of said tilting spring is coupled to a tilting spring lobe of said mobile spring loaded cam, while a second end of said tilting spring is coupled to said manual control member.

12. A device according to claim 10, wherein one end of the triggering spring is coupled to the spring loaded cam, while a second end of said triggering spring is coupled to a mounting plate.

13. A device according to claim 10, further comprising a second switch selectively communicating with said mobile spring loaded cam, said second switch serving either for signaling or as coil contacts.

14. A device according to claim 10, wherein said automatic interlock is of the electromagnetic type and made up of a permanent magnet in association with an unlocking coil.

15. A device according to claim 1, further comprising a tilting spring wherein a first end of the tilting spring is coupled to a tilting lobe of the spring loaded cam, while a second end of said tilting spring is coupled to said manual control member.

16. A device according to claim 15, wherein a first end of the triggering spring is coupled to the spring loaded cam, while a second end of said triggering spring is coupled to a mounting plate.

17. A device according to claim 15, further comprising a second switch selectively communicating with said mobile spring loaded cam, said second switch serving either for signaling or as coil contacts.

18. A device according to claim 15, wherein said automatic interlock is of the electromagnetic type and made up of a permanent magnet in association with an unlocking coil.

19. A device according to claim 1, a first end of the triggering spring is coupled to the spring loaded cam, while a second end is coupled to a mounting plate of the device.

20. A device according to claim 19, further comprising a second switch selectively communicating with said mobile spring loaded cam, said second switch serving either for signaling or as coil contacts.

* * * * *